US005927769A

United States Patent [19]

Pullen

[11] Patent Number: 5,927,769

[45] **Date of Patent: *Jul. 27, 1999**

[54] KID'S SAFETY LATCH

[76] Inventor: John Howard Pullen, 2510 Nace Rd., Troutville, Va. 24175

[ * ] Notice: This patent issued on a continued prosecution application filed under 37 CFR 1.53(d), and is subject to the twenty year patent term provisions of 35 U.S.C. 154(a)(2).

[21] Appl. No.: 08/740,852

[22] Filed: Nov. 4, 1996

Related U.S. Application Data

[60] Provisional application No. 60/010,514, Jan. 24, 1996.

[51] Int. Cl.[6] ..... E05C 1/12

[52] U.S. Cl. ..... 292/169.13; 16/115; 74/544; 74/546; 292/172; 292/192; 292/335; 292/347

[58] Field of Search ..... 292/335, 172, 292/192, 169.13, 347, 32, 332–336, 255; 74/544, 546; 16/115, DIG. 25, DIG. 30

[56] References Cited

U.S. PATENT DOCUMENTS

| | | | |
|---|---|---|---|
| 590,169 | 9/1897 | Schiek | 292/255 |
| 1,107,736 | 8/1914 | Wilkinson et al. | 292/335 |
| 1,302,873 | 5/1919 | Stiff | 292/335 |
| 2,454,672 | 11/1948 | Rosenthal et al. | 292/150 |
| 3,084,965 | 4/1963 | Carosello | 292/347 |
| 3,121,778 | 2/1964 | Sander et al. | 200/172 |
| 3,126,218 | 3/1964 | Andrews | 70/432 |
| 3,144,268 | 8/1964 | Rowe | 74/544 |
| 3,397,002 | 8/1968 | Russell et al. | 292/192 |
| 4,018,465 | 4/1977 | Ramler | 292/347 X |
| 4,475,313 | 10/1984 | Governale | 292/42 X |
| 4,565,079 | 1/1986 | Smith | 292/150 X |
| 5,141,268 | 8/1992 | Keller | 292/150 |
| 5,246,258 | 9/1993 | Kerschenbaum et al. | 292/244 X |
| 5,388,876 | 2/1995 | Saincome | 292/DIG. 65 X |
| 5,664,287 | 9/1997 | Sendelbach | 292/347 X |

FOREIGN PATENT DOCUMENTS

| | | | |
|---|---|---|---|
| 661855 | 3/1929 | France | 292/172 |
| 260146 | 9/1928 | Israel | 292/192 |
| 271928 | 2/1930 | Israel | 292/192 |
| 15595 | 9/1891 | United Kingdom | 292/172 |
| 365320 | 1/1932 | United Kingdom | 70/416 |

*Primary Examiner*—Lloyd A. Gall
*Attorney, Agent, or Firm*—Donavon Lee Favre

[57] ABSTRACT

This invention is directed to a door latch having an auxiliary bolt which activates the latch bolt, and the use of a latch to confine small children in the home. The auxiliary bolt has a hinged beveled end which pivots when the door is opened but is fixed when the door is closed to activate the latch. The latch is placed five feet above the floor to prevent a small child from opening the door. The latch has a guard plate below the door handle to prevent a small child from opening the latch with a stick. The latch can be mounted on any side of any door.

9 Claims, 6 Drawing Sheets

FIG. 3
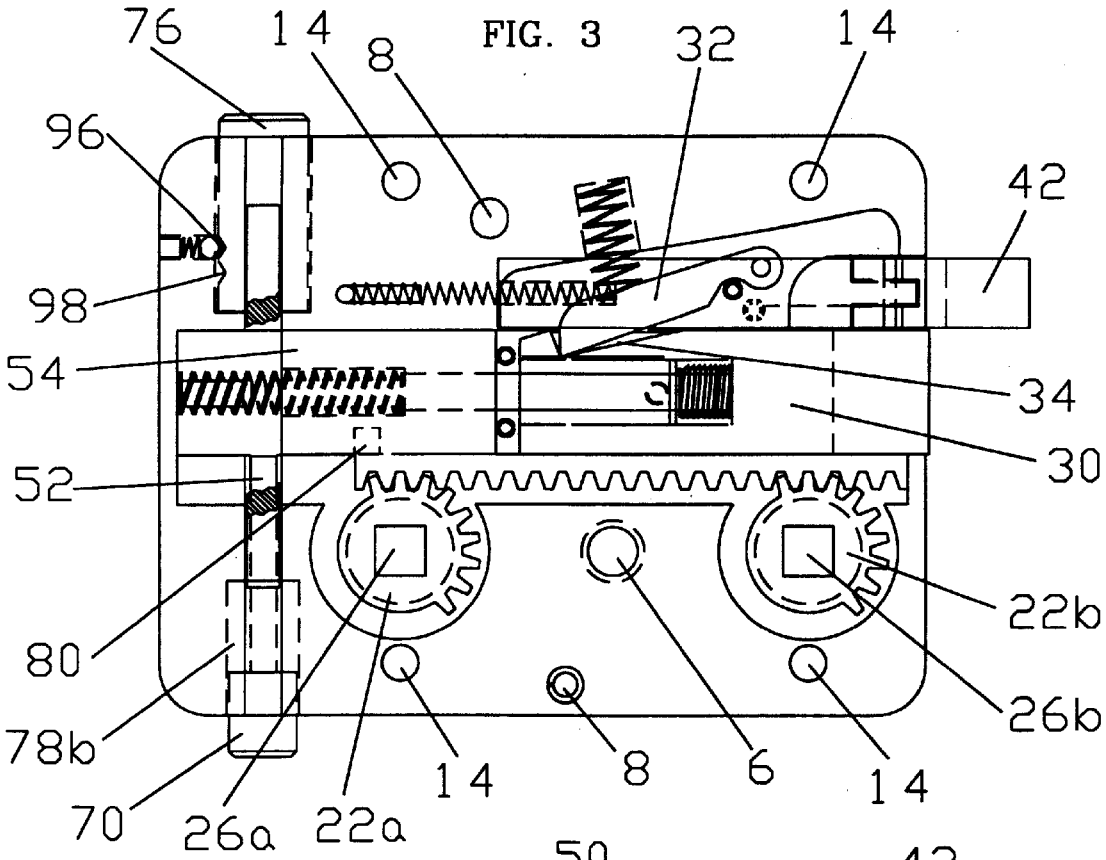
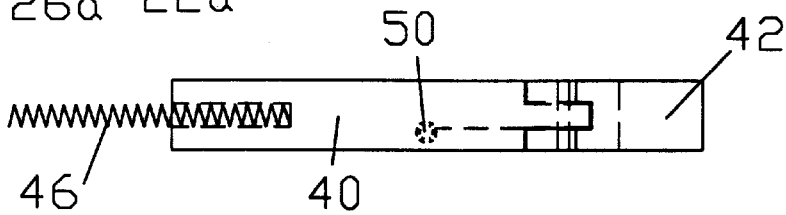
FIG. 4A
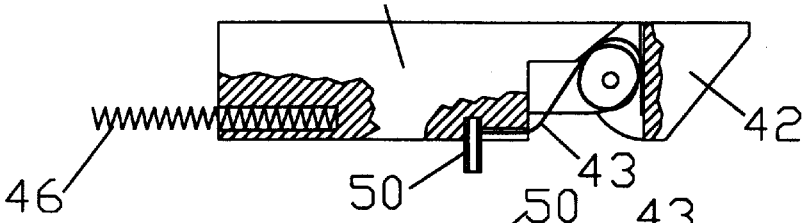
FIG. 4B
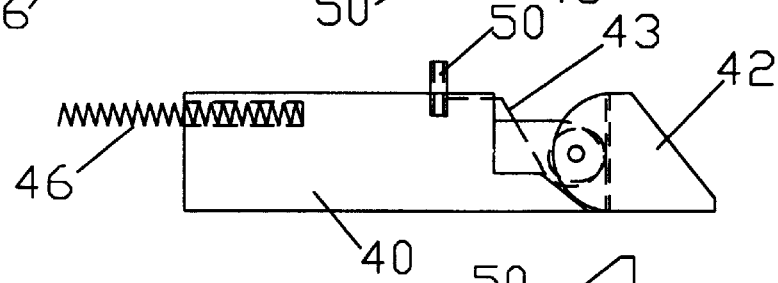
FIG. 4C
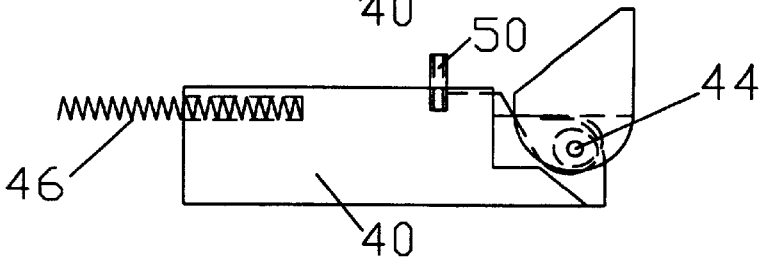
FIG. 4D FIG. 5
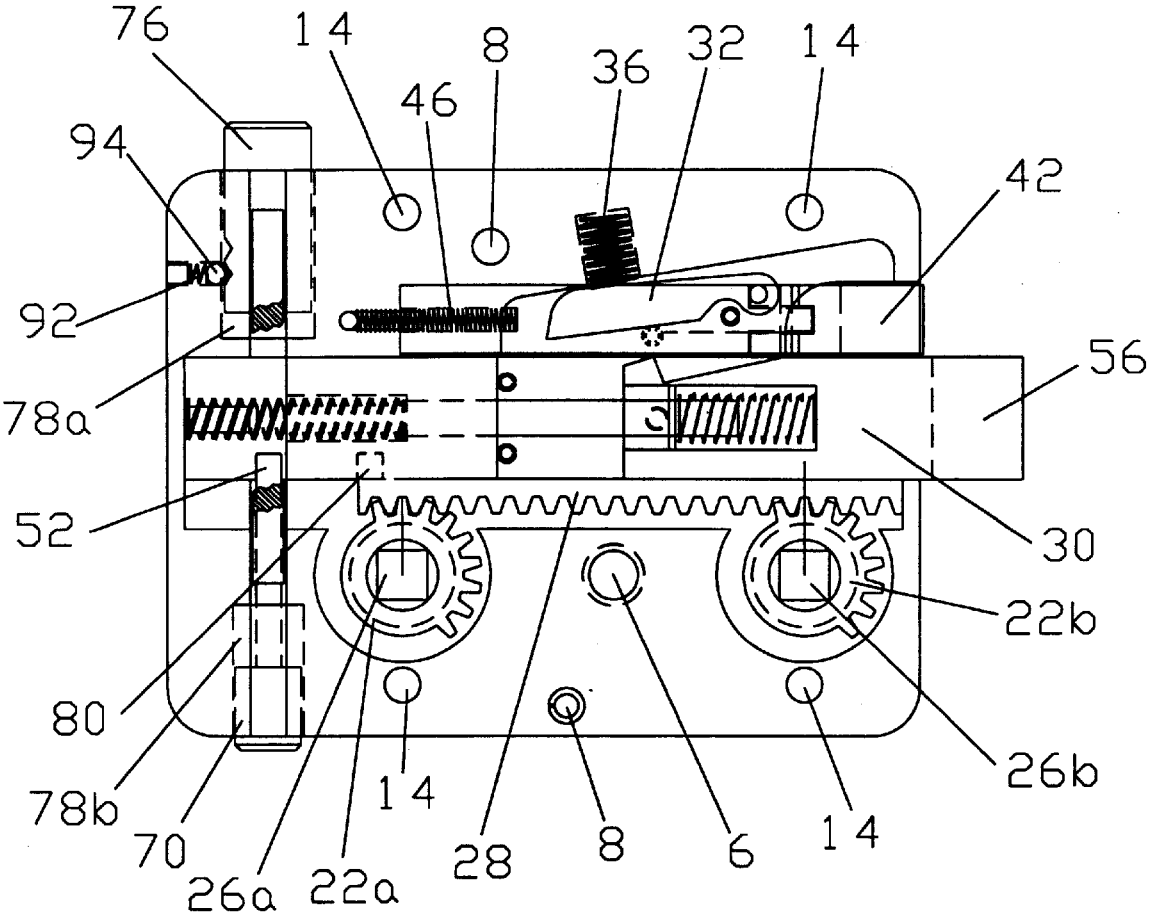
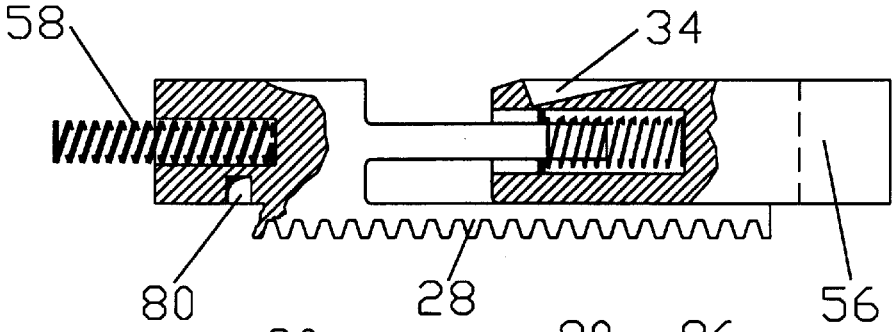
FIG. 6A
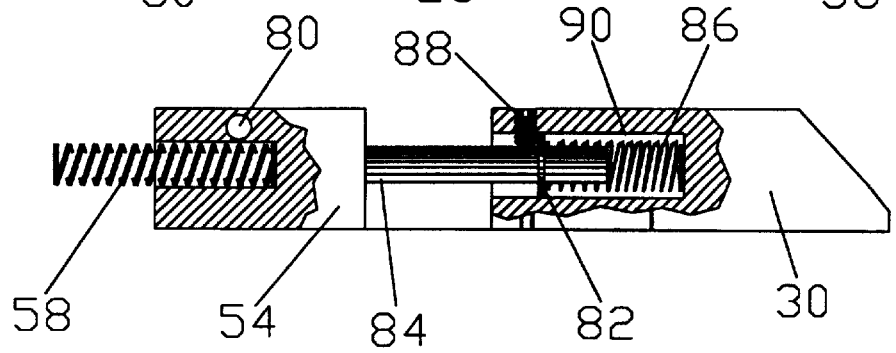
FIG. 6B

KID'S SAFETY LATCH

This patent application relies upon the filing date of corresponding Provisional Patent Application, Serial No. 60/010,514 entitled KIDS SAFETY LATCH of John Howard Pullen filed Jan. 24, 1996.

BACKGROUND OF THE INVENTION

This invention is directed to a door latch having an auxiliary bolt which activates the latch bolt, and the use of a latch to confine small children in the home.

DESCRIPTION OF THE PRIOR ART

U.S. Pat. No. 1,272,710 Ramsher (1918) discloses a spring pressed sliding bolt in a door lock casing. A rack bar is carried by the bolt. An outwardly spring pressed plunger is slidable within the casing and has its outer end projecting beyond the casing. A link pivoted within the casing transversely of the bolt has one end pivotally and slidably connected with the inner end of the plunger. A pawl is pivoted upon the other end of the link and normally engages the rack bar. Engagement of the projecting end of the plunger with the door jamb releases the pawl from engagement with the rack bar.

U.S. Pat. No. 1,968,285 Egan (1934) discloses a door latch having a casing and a latch bar having rack teeth mounted in the casing. A pair of slidably mounted pinions enmesh with the rack. A detent pawl is pivoted on the rack guide and is engagable with either of two slots in the bolt, depending upon whether the bolt is retracted or advanced. The latch bar has two trips depending therefrom and adapted to cooperate with the upper end of the pawl.

U.S. Pat. No. 2,136,539 Brinton (1938) discloses a night latch which allows one to open a door equipped with a night latch with one hand. When the bolt of the night latch is retracted from the keeper, as by means of the key, it is automatically held in retracted position until the door is opened and is then automatically released so as to be prepared to operate in the usual way when the door is subsequently closed. The night latch which is designed for an out opening door, may be used for an in-opening door. This is accomplished by removing the housing from the door so that the latch bolt, auxiliary bolt and the parts fixed to them may be taken out and reversed, that is turned upside down.

U.S. Pat. No. 2,279,591 Heyer (1942) discloses an improvement over the U.S. Pat. No. 2,136,539 of Brinton (1938). Heyer utilizes holding means to hold the latch bolt retracted once it is retracted, and provides an auxiliary bolt with means for releasing the latch bolt from the holding means when the auxiliary bolt is retracted. The auxiliary bolt is cammed backwardly or retracted relatively to the strike by the movement of the door into open position, once the latch bolt is retracted, the strike preferably serving to do this through its coaction with a cam surface on the auxiliary bolt. When so retracted, the auxiliary bolt releases the latch bolt for projection. The latch bolt of Heyer is held back when retracted by the usual manually operated means, even with the door or closure in open position, since in open position the auxiliary bolt is fully projected. Heyer provides suitable cam surfaces whereby the strike cams back or retracts the auxiliary bolt when the door is moved into closed position. This movement of the auxiliary bolt will, of course, release the latch bolt for projection. Heyer also provides means for maintaining his latch bolt in a deadlocking position. Heyer also provides means for maintaining his latch bolt retracted at all times. His double beveled auxiliary bolt then provides a yielding resistance to the opening and closing of the door.

U.S. Pat. No. 4,683,741 Fields (1987) discloses a battery operated electrical circuit including a switch operable by the lock turn buttons, and a light emitting diode mounted within the door knobs so as to be operable on locking the door to provide a flashing light visible from the outside of the door. This patent is representative of patents disclosing lights that indicate when a door is locked.

SUMMARY OF THE INVENTION

While the locks of the prior art all represent significant advances in the lock art, they still suffer significant short comings. For instance, the conventional prior art latch bolt is released from its retracted position when the door is opened. This requires that the conventional prior art latch bolt strike the striker plate every time the door is closed. If the force closing the door is not sufficient, the spring on the prior art latch bolt will prevent the door from closing. If the force is too strong, the conventional prior art latch bolt will twist in the housing, bind and not retract. Also continuous opening and closing of the door will tend to wear a groove in the cammed surface of the conventional prior art latch bolt causing it to malfunction. The present invention solves the problem by the use of an auxiliary bolt which only releases the latch bolt when the door is closed, thus avoiding malfunctions.

The present invention is also directed to a latch to be placed on a door at least five feet above the floor so that a child cannot reach it. The latch contains an auxiliary bolt having a trip pin. When the door is closed, the strike causes the auxiliary bolt to move into the latch. The pin on the auxiliary bolt trips a catch which releases the latch bolt, locking the door. The beveled end of the auxiliary bolt is pivoted so that opening the door causes the beveled end to pivot and not transmit force to the main body of the auxiliary bolt. However, when the beveled end of the auxiliary bolt strikes the strike plate, the auxiliary bolt is retracted, the pin trips a spring biased dog which rests in a notch in the latch bolt, releasing the latch bolt.

More specifically the latch for a hinged structure of the present invention is contained in a casing. The latch has a spring pressed latch bolt having a notch therein. A rack gear is attached to the latch bolt. A handle, operable from either side of the casing, rotates the spur gear and retracts the latch bolt into the casing to a predetermined position. A dog rotatably positioned in the notch, is held in the notch by a spring positioned between the casing and the dog. An auxiliary bolt, spring biased to project from the casing is slidable relative to the casing. A pin extending from the auxiliary bolt is movable into contact with the dog when the auxiliary bolt is retracted into the casing to release the dog from the notch and release the latch bolt to the locked position.

The auxiliary bolt has a beveled end which protrudes from the casing in an unretracted mode. A hinge joins the beveled end to a main body of the auxiliary bolt. The hinge allows the beveled end to pivot when the door is opened, but does not allow the beveled end to pivot when the door is closed. Force on the beveled end causes the auxiliary bolt to retract, and move the dog from the notch thus releasing the latch bolt and locking the hinged structure.

The beveled face of the auxiliary bolt is positioned so that the beveled face strikes a striker plate when the door is closed.

The latch is placed on a door at least five feet above the bottom of the door so that a child cannot reach it. A guard plate extends parallel to the latch and perpendicular to the door and below the latch to prevent a child from opening the latch by using a long object such as a stick to turn the latch handle.

The latch has no protrusions extending from either side that would prevent it from being mounted on a door other than the removable handles and handle shaft, thus allowing a single latch to be mounted on a right or left hand swing door, on either side of the door without modification.

The latch has two rack gear driven spur gears, one spur gear spaced further than the second spur gear from where the auxiliary bolt projects from the casing, whereby one spur gear could be used for narrow framed doors such as storm or screen doors and the other spur gear could be used for a wide framed door to open the latch.

The latch has a pin positioned for insertion into the latch bolt to hold the bolt in an unlocked position or in a locked position.

The latch also has a switch activated by movement of the latch bolt and a light or buzzer activated by the switch to indicate whether the latch bolt was in the locked on unlocked position. A timer prevents the light or buzzer activation if the door is only temporarily unlocked.

While the present invention is primarily directed to the above identified latch, it is also directed to the safety feature of any lock being positioned at least 5 feet above the bottom of the door to prevent a small child from activating the lock. The additional feature of any lock positioned at least five feet above the bottom of the door or the floor is a guard plate positioned below the lock to prevent a child from using a long object such as a stick to open the lock.

Also the auxiliary bolt of the present invention can be used in many other types of latches. The auxiliary bolt has a beveled end to activate a latch bolt. The improvement of the present auxiliary bolt over prior art auxiliary bolts is a spring biased hinge between the beveled end of the auxiliary bolt and the remainder of the auxiliary bolt whereby movement only in one direction causes the auxiliary bolt to activate the latch bolt.

BRIEF DESCRIPTION OF THE DRAWINGS

FIG. 3 is a side sectional view of the latch mechanism of the present invention with the cover removed and the latch's main bolt in the retracted open position.

FIG. 4A is a side sectional view of the secondary or auxiliary bolt showing the spring biased, hinged break-away beveled end and position of the trip pin.

FIG. 4B is a top sectional view of the auxiliary bolt showing the beveled end in extended position.

FIG. 4C is a view of the auxiliary bolt of FIG. 4B rotated 180°.

FIG. 4D is a top sectional view of the auxiliary bolt showing the pivot pin for the beveled end in the break away position and the spring providing the bias for the beveled end of the auxiliary bolt.

FIG. 5 is a side sectional view of the latch mechanism of the present invention in the dead lock condition and the secondary bolt retracted by contact with the strike to release the main bolt to latched position.

FIG. 6A is a side view of the main bolt latch.

FIG. 6B is a top view of the main bolt latch.

DESCRIPTION OF THE PREFERRED EMBODIMENTS

Figure 1:
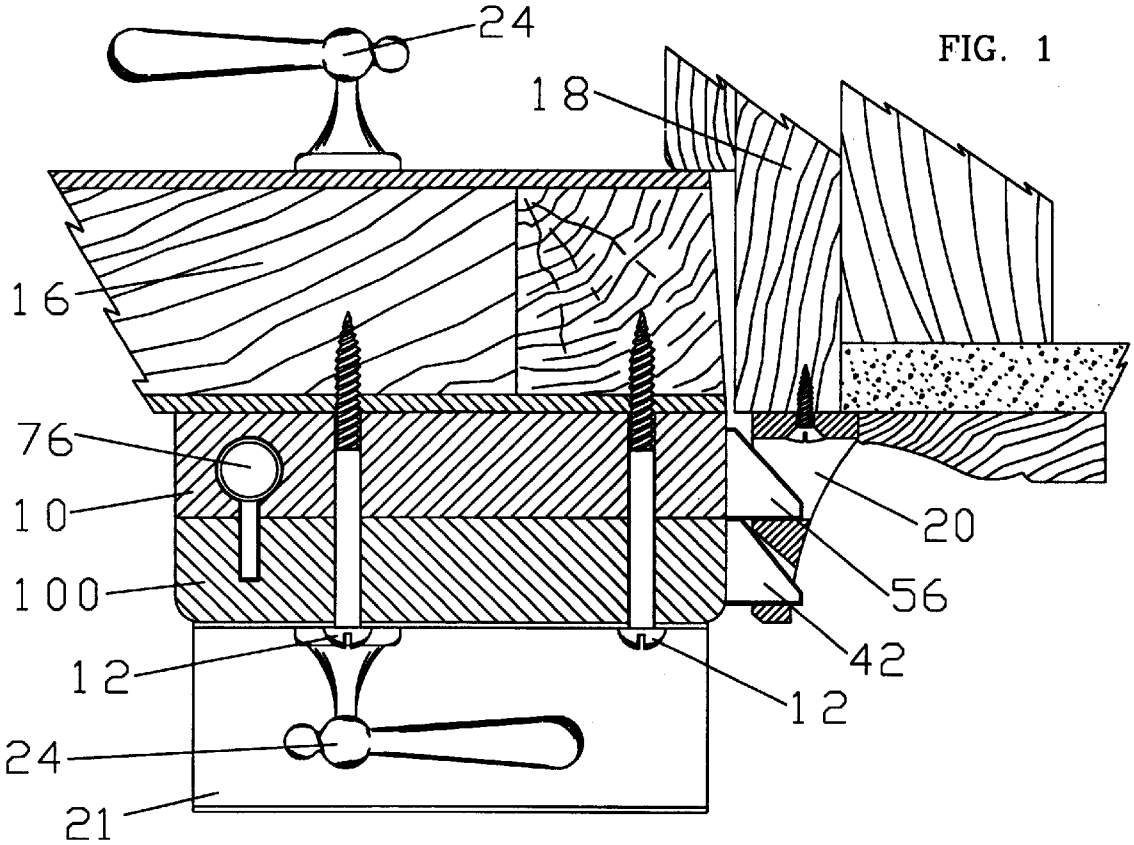
FIG. 1 is a top view of the latch, having a guard plate positioned under a handle, mounted on a door and a strike mounted on a door frame.
Figure 2:
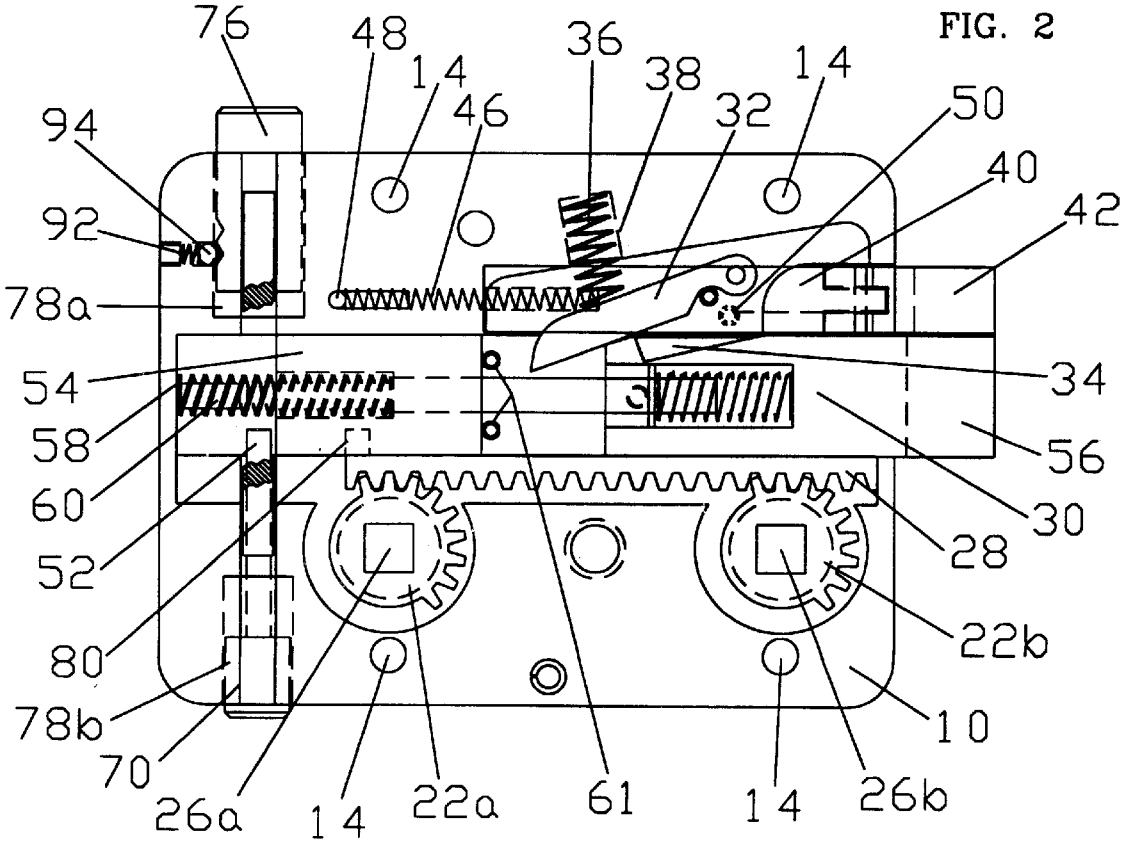
FIG. 2 is a side sectional view of the mechanism of the latch mechanism of the present invention with the cover removed in the latched condition.

Referring now to the drawings and more especially to FIGS. 1–3, there is shown the latch assembly of the present invention having a screw hole 6 to allow the casing to be held together and casing alignment dowels and holes 8 to properly align the two sections of the casing (see FIG. 3). The latch casing 10 containing the latching mechanism is secured by suitable screws 12 through mounting holes 14 to a door 16 cooperable with a door jamb 18 on which is supported a strike 20. Guard plate 21 extends outwardly from the latch casing to prevent a small child from using a stick to reach up and open the latch from the inside. Spur gears 22*a* and 22*b* are rotatably mounted in casing 10 and are rotated by turning a handled shaft 24, optionally having a pendant extension rod 25, in a square hole 26*a* or 26*b*. The two spur gears 22*a* and 22*b* are provided to allow for a door knob or handled shaft 24 to be mounted different distances from the strike 20. If locks are to be made for a specific type of door, only one spur gear 22*a* or 22*b* is necessary. The latch casing 10 with spur gear 22*b* is designed for storm doors, screen doors or other doors with narrow frames. Spur gear 22*a* is designed for regular doors. It does not matter which spur gear 22*a* or 22*b* is turned so for further discussion reference will be made to spur gear 22 which may be considered to be either spur gear 22*a* or 22*b*. The extension rod 25 provides a means whereby the handle is extended by from one to three feet on the outside of a door whereby a small child can open the door from the outside.

The rotation of spur gear 22 will drive rack 28 and retract main latch bolt assembly 30 into the latch housing 10. The movement of the main latch bolt assembly 30 will cause the main bolt latch trip 32 to drop into a notch 34 holding the main latch bolt assembly 30 in a retracted position as is shown in FIG. 3. The latch trip 32 is spring loaded by spring 36 positioned in cylindrical recess 38. The door 16 can now be opened.

When the door 16 is opened, the secondary bolt 40 will break away as is shown in FIG. 4D. By "break away" is meant that tapered end 42 of secondary bolt 40 which is normally biased to its extended position by spring 43 will pivot on pin 44 and release from strike 20. Once released from strike 20 the tapered end 42 of secondary bolt 40 will extend to its normal position as shown in FIG. 4B. Secondary bolt 40 is biased in a position extending from latch casing 10 by spring 46 the other end of which is attached to a pin 48. The major portion of pin 48 is coaxial with spring 46. The part of the pin 48 which extends from spring 46 is bent at a right angle and the end of the pin 48 adjacent the bend is embedded in latch casing 10.

When the door 16 is closed, the secondary bolt 40 will wedge on strike 20 because tapered end 42 can only pivot in one direction. The movement of tapered end 42 against strike 20 will cause secondary bolt 40 to be retracted into housing 10. Trip pin 50 is partially embedded in and partially extending from secondary bolt 40. The movement of secondary bolt 40 into housing 10 causes trip pin 50 to come into contact with the main bolt latch trip 32 wedging the main bolt latch 32 out of notch 34 releasing main latch bolt 30 assembly allowing main latch bolt 30 assembly to return to normal or door closed position (see FIG. 2). Spring 46 will then push the secondary bolt 40 back out to the normal position shown in FIG. 2.

When fully projected the main latch bolt 30 assembly can be deadlocked by movement of deadlock pin 52 behind rear latch bolt section 54 of main latch bolt 30. Deadlock pin 52 prevents spur gear 22 from turning, thus preventing rack gear 28 from retracting the protruding section 56 of main latch bolt 30 which extends into strike 20. Rear latch bolt section 54 is normally biased against retraction by rear main latch bolt spring 58 which is positioned on pin 60 in the rear inner wall of housing 10. Rear latch bolt section 54 is prevented from forward movement out of housing 10 by dowel pins 61. See FIGS. 6A, and 6B for the structure of the main latch bolt 30.

Figure 7:
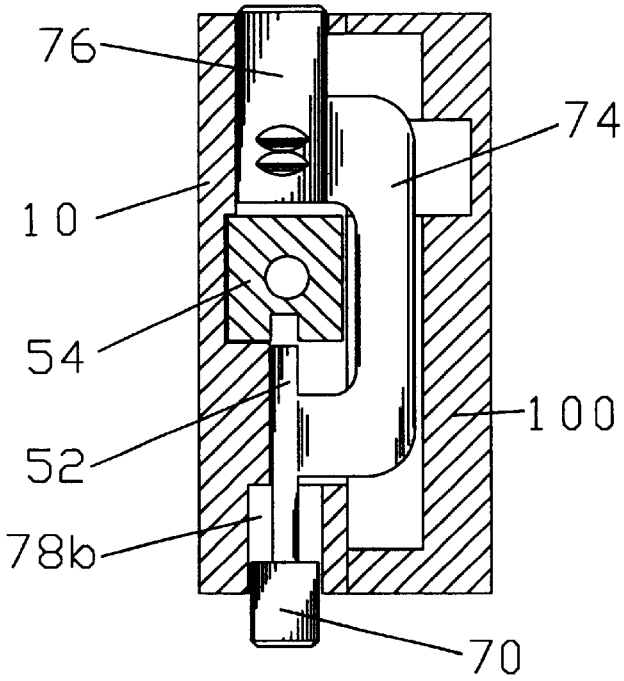
FIG. 7 is a sectional end view of the night lock showing the dead latch pin assembly and the latch casing.

Deadlock pin 52 is moved into position by pressing on pushbutton 70 in housing 10. Deadlock pin 52 extends from and is attached to pushbutton 70. A bridge 74 attached to pushbutton 70 is also attached to a second push button 76 which is coaxial or parallel to pushbutton 70 (see FIG. 7). Push button 76 is positioned in cylindrical recess 78*a*. Bridge 74 extends around the path of travel of rear latch bolt section 54.

Figure 8:
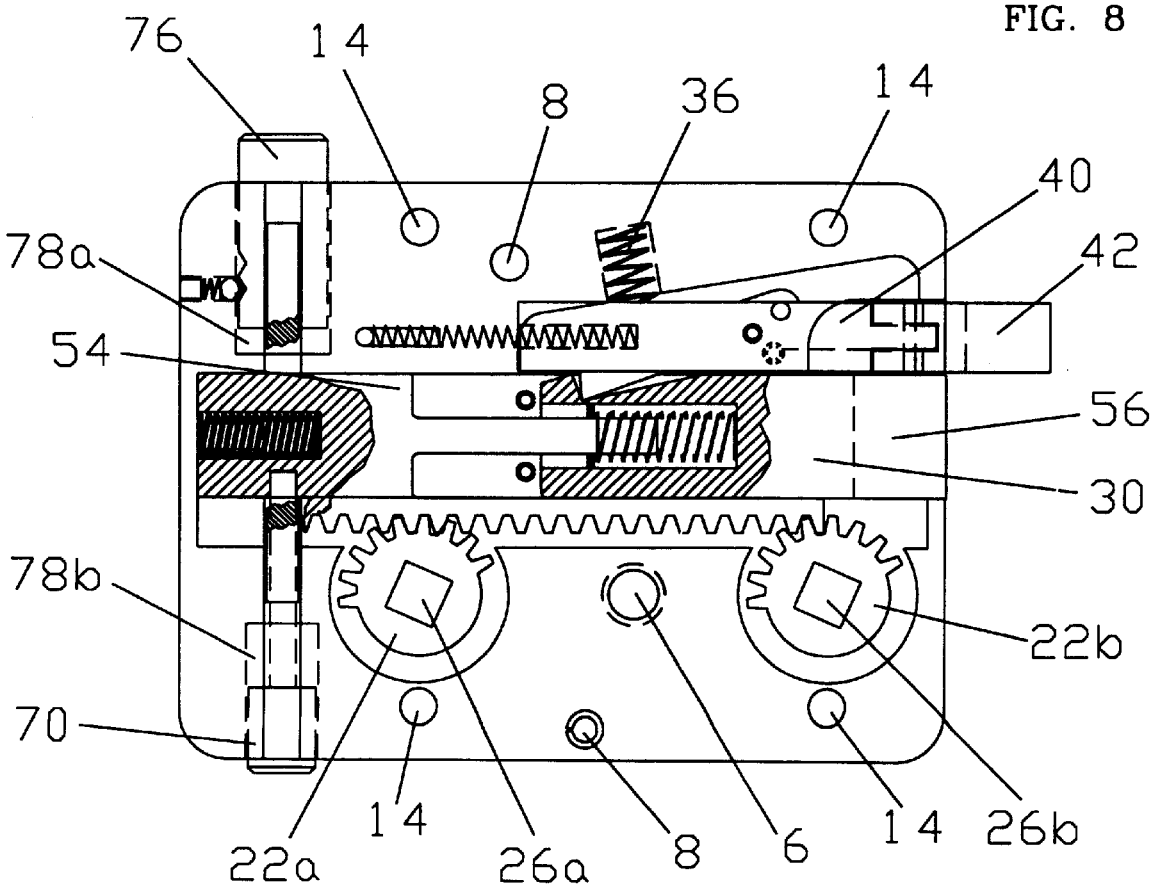
FIG. 8 is a side view of the main latch bolt in open or retracted position and held in the retracted position by the dead latch pin where it will stay until manually released.

It is also a feature of the present invention that when the main latch bolt assembly 30 is retracted as shown in FIG. 8, it can be held retracted. This is accomplished by turning latch handle 24 to the open position. This retracts the main latch bolt assembly 30 into housing 10. Push button 70 is then used to push pin 52 into cylindrical cavity 80 of rear latch bolt section 54 (see FIGS. 6A and 6B). Upon release of latch handle 24, the main latch bolt assembly 30 will be held in the retracted position by pin 52. A spring retaining flange 82 around rod 84 prevents the end of rod 84 extending beyond the flange 82, from passing set screw 88 in the cylindrical cavity 90 as shown in FIG. 6B. The spring retaining flange around rod 84 maintains rod spring 86 in compression and biases the protruding section of latch bolt 56 to an extended position. Push button 76 is held in its in or out position by a detent consisting of a spring 92 and a ball 94 which is held in one or the other of two V shaped recesses 96 and 98 in push pin 76 (see FIGS. 2, 3 and 7). This is useful for grandparents when there are no grandchildren around and there is no necessity to open the safety latch each time the door is opened. A grandparent could retract the main bolt 30 and push in on button 70 which would lock in main bolt 30. This would keep the main bolt retracted until the grandchildren returned or the grandparents wanted to put the lock back in service by pushing in on button 76.

Figure 9A:
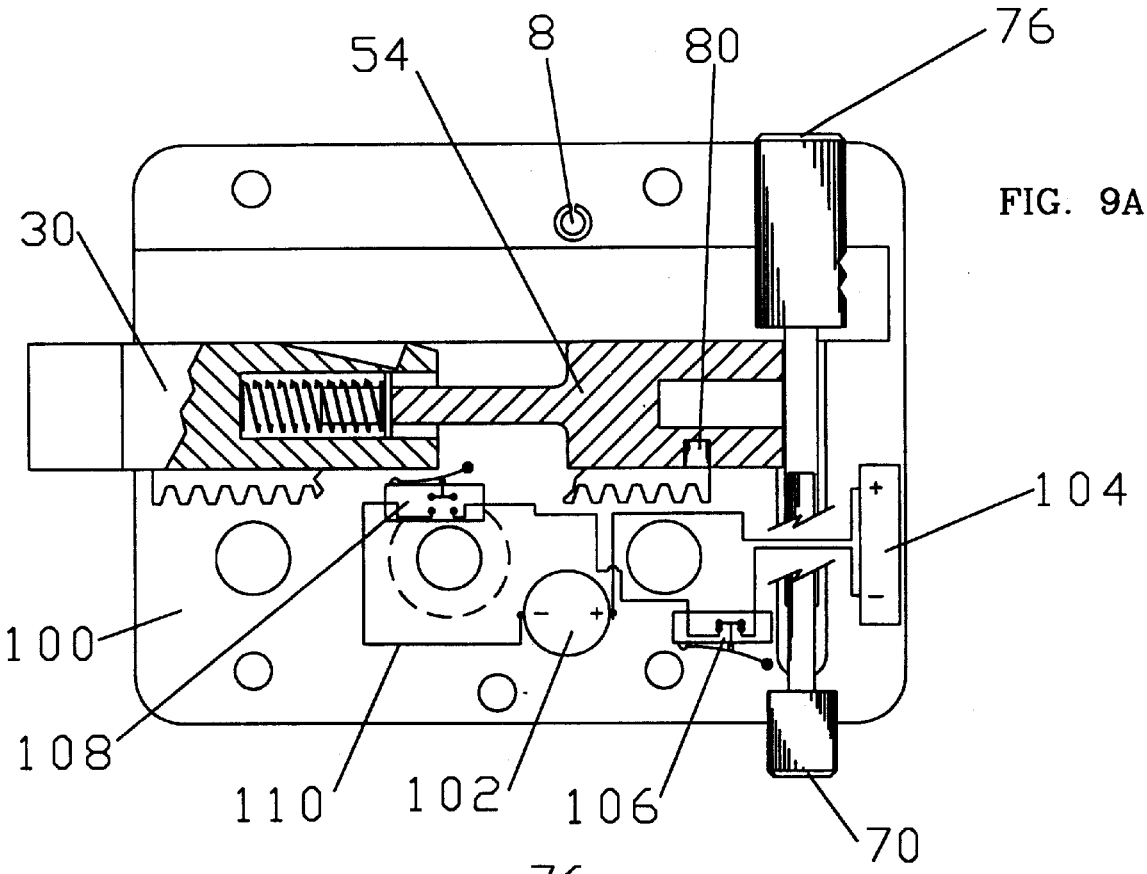
FIGS. 9A and 9B are views of the electrical warning system and its operation.
Figure 9B:
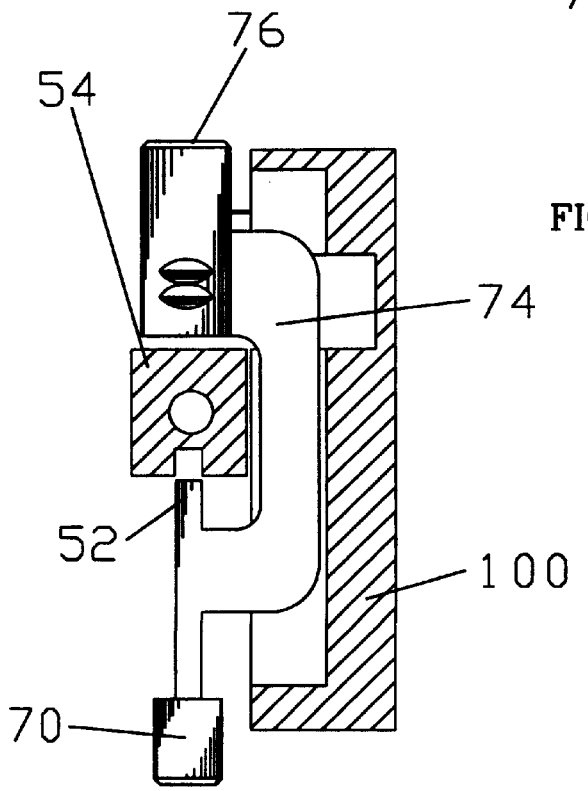
Figure 10:
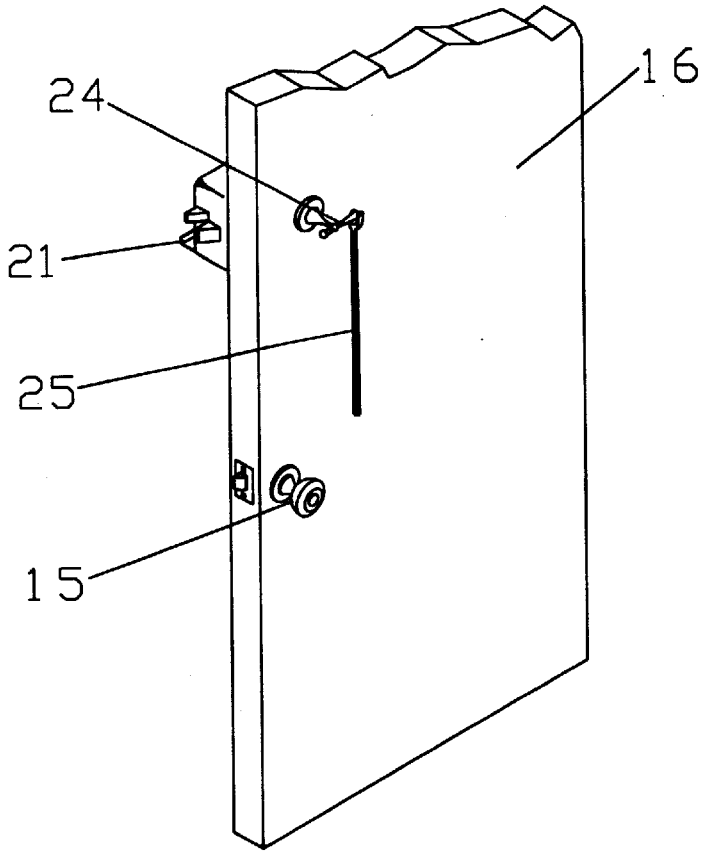
FIG. 10 shows the outside of a door having an extension handle to allow a child to unlatch the door.
Figure 11A:
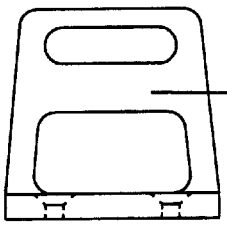
FIGS. 11A and 11B show a strike to be mounted on a door frame extending perpendicular from a door.
Figure 11B:
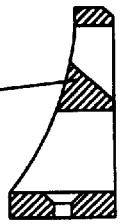
Figure 12A:
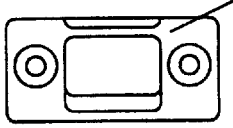
FIGS. 12A and 12B show a strike to be mounted on a door frame extending parallel from a door.
Figure 12B:
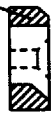

The electrical system used in FIG. 9 is another safety feature that would let a person who opened the door know if the main bolt 30 is retracted in the housing and not in the locked position, for example, if a person were to go outside and unlocked the latch and the telephone rang and the person returned to answer the phone and forgot the latch was unlocked. After ten to fifteen seconds a light and buzzer reminding the person that the latch was unlocked would be activated. The person could then open the door and close it again and relock the latch.

The operation of the electrical system is as follows. The housing for the electrical system is shown as 100. The housing 100 contains a small battery 102, an electronic timer, light and buzzer assembly 104, contact points 106 and 108 and electrical wire 110. When the main bolt 30 is retracted it trips the contact points 108 and closes them closing the circuit to the timer, light and buzzer 104. The light and buzzer will be activated after fifteen seconds. The hot or + side of the battery 102 is electrically connected by a wire 110 to the timer, light and buzzer 104 directly. The ground or – wire completes a circuit through points 106 or 108. If the night lock button 70 is pushed in, it will trip another set of contact points 106 and this will open the circuit and nothing will happen even if the main bolt 30 is retracted to the open position.

I claim:

1. A latch for a door comprising a spring pressed latch bolt having a notch therein, a casing, a handle operable from either side of the casing for retracting the latch bolt into the casing to a predetermined position, a dog rotatably positioned in the notch, a spring positioned between the casing and the dog biasing the dog into the notch, an auxiliary bolt, spring biased to project from the casing and slidable relative to the casing, a pin extending from the auxiliary bolt movable into contact with the dog when the auxiliary bolt is retracted into the casing to release the dog from the notch and releasing the latch bolt to a locked position, the auxiliary bolt comprising a main body portion and a beveled end portion, having a beveled face, joined to the main body portion by a spring biased one way hinge which does not allow rotary movement from an extended position of the beveled end portion when the beveled face is in contact with a striker plate, causing the auxiliary bolt to retract by movement across the striker plate, a striker plate having an opening therein for the insertion of an extended end of the auxiliary bolt in unretracted position when the door is closed.

2. The latch of claim 1 wherein a rack gear is attached to the latch bolt, a spur gear meshes with the rack gear, and by rotating the spur gear with the handle the latch bolt is retracted.

3. The latch of claim 1 in combination with a door positioned above a floor, the latch being placed on the door at least five feet above the floor so that a child cannot reach it.

4. The latch of claim 3 in combination with a guard plate extending below the latch to prevent a child from opening the latch by using a long object such as a stick.

5. The latch of claim 1 having no protrusions, other than the handle, extending from either major side, thus allowing a single latch to be mounted on right or left hand swing doors, inside or outside without modification.

6. The latch of claim 1 further characterized by the presence of two spur gears capable of driving a rack gear, one spur gear spaced further than the second spur gear from where the auxiliary bolt projects from the casing, whereby one spur gear could be used for narrow framed doors to open the latch and the other spur gear could be used for a wide framed door.

7. The latch of claim 1 further characterized by a pin positioned for insertion into the latch bolt to hold the bolt in an unlocked position and allow the door to be retrained in the closed position by the auxiliary bolt.

8. The latch of claim 1 further characterized by a pin positioned for insertion behind the latch bolt to hold the bolt in a locked position.

9. The latch of claim 1 further characterized by a switch activated by movement of the latch bolt and a light or buzzer activated by the switch to indicate whether the latch bolt was in a locked on unlocked position.

* * * * *